US006786449B2

(12) United States Patent
Marcle-Geler et al.

(10) Patent No.: US 6,786,449 B2
(45) Date of Patent: Sep. 7, 2004

(54) ANGLE-BAR ARRANGEMENT FOR WEB-PROCESSING ROTARY PRESSES

(75) Inventors: Thierry Marcle-Geler, Senlis (FR); Jean Mariotti, Monchy-St-Eloi (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/989,224

(22) Filed: Nov. 20, 2001

(65) Prior Publication Data

US 2002/0113164 A1 Aug. 22, 2002

(30) Foreign Application Priority Data

Nov. 22, 2000 (DE) ..... 100 57 886

(51) Int. Cl.[7] ..... B65H 23/32

(52) U.S. Cl. ..... 242/615.12; 242/615.11; 242/615.21

(58) Field of Search ..... 226/97.3; 242/615.12, 242/615.11, 615.21

(56) References Cited

U.S. PATENT DOCUMENTS

| | | | | | |
|---|---|---|---|---|---|
| 2,689,196 | A | * | 9/1954 | Daniels | 242/615.12 X |
| 3,744,693 | A | | 7/1973 | Greiner | 226/97 |
| 4,342,413 | A | * | 8/1982 | Reba | 242/615.12 |
| 4,406,388 | A | * | 9/1983 | Takashi et al. | 242/615.11 X |
| 4,925,077 | A | * | 5/1990 | Daane et al. | 242/615.12 |
| 5,233,919 | A | | 8/1993 | Fecteau et al. | 101/228 |
| 5,273,201 | A | | 12/1993 | Hambrecht | 226/197 |
| 5,520,317 | A | | 5/1996 | Eckert et al. | 226/197 |
| 5,797,531 | A | | 8/1998 | Marmin | 226/97 |
| 5,947,411 | A | * | 9/1999 | Burke et al. | 242/615.12 |
| 6,505,792 | B1 | * | 1/2003 | Rocheleau et al. | 242/615.12 |

FOREIGN PATENT DOCUMENTS

| | | |
|---|---|---|
| CH | 616367 | 3/1980 |
| DE | 2026355 | 11/1971 |
| DE | 4311438 | 10/1994 |
| DE | 4117094 | 10/1995 |
| FR | 2740070 | 4/1997 |
| GB | 2256188 | 12/1992 |

OTHER PUBLICATIONS

Kipphan, Helmut. Handbook of Print Media—Technologies and Production Methods. Springer, pagers 270–271.*

* cited by examiner

*Primary Examiner*—Kathy Matecki
*Assistant Examiner*—E. Langdon
(74) *Attorney, Agent, or Firm*—Davidson, Davidson, & Kappel, LLC

(57) ABSTRACT

The present invention is directed to an angle-bar arrangement for deflecting material webs on an angle-bar jacket (1) which is provided with a plurality of air outlet openings (2). Closing elements (6), which seal off respective air outlet openings (2), are movably accommodated in the angle-bar jacket (1). Compressed air enters into the hollow space bounded by the movably accommodated closing elements (6). The movable closing elements (6), whose outer contour (7) corresponds to the inner wall (3) of the angle-bar jacket (1), are driven independently of one another by actuators (18, 20).

19 Claims, 4 Drawing Sheets

ANGLE-BAR ARRANGEMENT FOR WEB-PROCESSING ROTARY PRESSES

Priority is hereby claimed to German Patent Application No. 100 57 886.1, which is also hereby incorporated by reference herein.

BACKGROUND INFORMATION

The present invention is directed to an angle-bar arrangement for web-processing rotary presses, in which different material-web widths are processed or produced by longitudinal slitting, either on commercial web presses or newspaper rotary presses.

French Patent Application No. 2 740 070 describes an angle-bar arrangement having openings in the angle-bar jacket which are able to close in response to pressure. In a tube-shaped member configured within the angle-bar jacket, the openings in the angle-bar jacket are positioned so as to be closable with respect to the curvature of the jacket surface by vertically movable closing elements. If a material web covering the jacket of the angle bar closes off the openings in the jacket, a counterpressure acting on the closing element builds up, causing the closing element to drive completely into the tubular member, thereby releasing the opening in question in the angle-bar jacket. As a result, an air cushion can be built up in the region in which the material web to be deflected actually covers the angle-bar jacket, so that the air cushion merely forms underneath the material web, and the openings not covered by the material web remain closed.

U.S. Pat. No. 5,233,919 relates to a controllable angle bar device for turning a material web. Disposed within an exterior pipe, used as an angle bar and having a multiplicity of air outlet openings, is an additional pipe or zone tube. This zone tube is used as a regulating tube, and it defines an annular space with the inner side of the angle-bar jacket. The zone tube is divided into a plurality of mutually isolated zones which extend in the longitudinal direction. Provided on the zone tube within the angle bar jacket is at least one outlet opening, whose position is coordinated with the outlet openings in the angle bar jacket. In addition, a controller tube is provided, which is disposed within the zone tube, and in the circumferential direction thereof, has at least two zonal combinations of outlet openings differing from one another, and is rotatably accommodated within the zone tube.

German Patent No. 41 17 094 C2 describes a compressed air-fed angle bar for deflecting material webs in rotary presses. The ends of the angle bar are movably supported by bearing members on cross bars. Air outlet openings are situated in axial rows over the periphery of the hollow formed angle bar at defined spacings. Configured so as to be supported independently from one another in the hollow space of the angle bar are two adjusting spindles, which, over their entire length, have an air duct for supplying compressed air to the hollow space of the angle bars. Each of the adjusting spindles carries a non-rotatable piston, which is axially displaceable by way of the adjusting spindles by a remote-controlled actuator. Configured so as to extend radially in each piston are air outlet openings, which extend at a defined spacing to one another in axial rows of different lengths, the axial rows being radially offset from one another and being coordinated in their positions with the corresponding air outlet openings in the jacket of the angle bar.

An approach is also known where manually adjustable membrane sections are accommodated at individual outlet openings on the inside of the angle bars. The membrane sections can be set back into the inside of the angle bar by pins extending through the jacket of the angle bar, or be so positioned that they close the air outlet openings in the jacket of the angle bar. The membrane sections can cover either one or a plurality of side-by-side outlet openings in the angle-bar jacket. This approach requires that printer personnel climb into the angle-bar superstructure, and either close or open the appropriate number of outlet openings in the angle-bar jacket at each individual angle bar, depending on the material web width running thereon. If one of the adjustable membrane sections fails, the entire angle bar must be disassembled, and all membrane sections must be restored.

SUMMARY OF THE INVENTION

In view of the described, to some extent very costly technical approaches, an object of the present invention is to set a precisely defined zone on an angle bar where compressed air of a low pressure level will flow out.

The present invention provides an angle-bar arrangement for deflecting material webs in a rotary press comprising an angle-bar jacket (1), which is provided with a plurality of air outlet openings (2). Closing elements (6), which are provided in the air outlet openings and can seal off the air outlet openings (2), are able to move, and compressed air is fed into a hollow space of the angle-bar jacket (1), which is delimited by the movable closing elements (6). The closing elements (6) are guided via rails in the angle-bar jacket (1) and are mutually independently movable by actuators (18, 20).

The advantages that are attainable using the approach of the present invention are evident above all in that a remotely controlled, precise adjustment of the air outlet zone is now possible, i.e., the position of the air cushion underneath a material web may now be exactly specified in adjustable fashion. In addition, the piston settings may be controlled remotely, eliminating the need for personnel to climb into the angle-bar superstructure. The air cushion may be adjusted at the angle-bar jackets, within the framework of the presetting, as a function of the material web width to be processed that results in the rotary press. An additional benefit is derived in that, by precisely adapting the closing element which, at any one time, seals off the air outlet openings not needed in the angle-bar jacket, to the inner contour of the angle-bar jacket, a high degree of seal tightness of the angle-bar jacket may be achieved with respect to the closing elements which are movable in this jacket. This signifies less faulty outflow of air and, thus, a better engineered supplying of compressed air to the angle-bar jackets. Moreover, since the closing elements, which traverse on rails in the angle-bar hollow space, are each able to be driven separately, the material web running on the angle-bar jacket does not necessarily have to do so on the center of the angle bar. Mutually independently drivable closing elements make it possible to set contact-free running of the material webs at any desired location on the periphery of the angle bars, i.e., no limits are set to the running of a material web about the angle-bar jacket with respect to the central position of the web.

One variant of the idea underlying the present invention provides the closing elements of the angle-bar arrangement to be driven on driving spindles. The driving spindles may be accommodated in the hollow space of the angle-bar arrangement, extending axially to the angle-bar length.

The compressed-air line that ensures the compressed-air supply to the hollow space of the angle-bar arrangement may advantageously be placed in one of the closing elements which traverse along rails in the angle-bar hollow space. For this purpose, a compressed-air line may be screwed into the bore hole of the movable closing element, while, a sealing element may be set in at the diametrically opposed closing element within the angle-bar hollow space, to seal off its bore hole.

Secured above the angle-bar sleeve to seal off the same from compressed air losses that arise, is a plate-shaped sealing surface that extends over the axial extent of the angle bars.

In another variant of an embodiment of the idea underlying the present invention, the closing elements guided along rails within the hollow space of the angle-bar jacket may be driven axially within the hollow space of the angle-bar jacket by spindle heads which are actuated independently of one another by driving spindles. In this variant of an embodiment, the driving of the closing elements within the hollow space is not the result of direct action on the closing elements, rather the driving action may be transmitted via permanent magnets arranged in the spindle heads to the closing elements which are movable within the hollow pace of the angle-bar jacket. For this, permanent magnets, which cooperate with the magnets of the spindle heads, are set in the closing-element surfaces facing the spindle heads, the closing elements being movable within the hollow space of the angle-bar configuration. These permanent magnets are preferably able to be enclosed in recesses formed on the top side of the movable closing elements, resulting in a smooth surface on the movable closing element.

To ensure a precise guidance of the spindle heads, which are each assigned to one closing element that is able to slide within the hollow space of the angle bars, each spindle head is provided with a plane contact surface at its side facing the movable closing element. The lateral guidance of the spindle heads, whose threaded section is penetrated by driving spindles configured above the angle-bar jacket, is ensured by guide rails which may be accommodated at the side of the surface that seals off the hollow space of the angle-bar jacket. The rail-type guide elements include a projection which extends beyond the lateral guide surface of the spindle heads, ensuring that the plane surfaces of the movable spindle heads are always guided in cant-free manner on the top side of the sealing surface covering the hollow space of the angle-bar jacket. In this variant of an embodiment, the independent drives of the adjusting spindles for the spindle heads provided with permanent magnets are able to be positioned outside of the hollow space of the angle-bar jacket, e.g., on its top side.

The angle bars designed in accordance with the present invention having mutually independently movable closing elements in the hollow space of the angle bar jacket may preferably be installed on angle-bar superstructures of commercial web presses or newspaper rotary presses. In this context, it is unimportant whether the angle bars according to the present invention are designed to be supported in a stationary mount, or whether their angular position may be varied within the angle-bar superstructure, or whether they are accommodated on movable slide rails in side walls of the angle-bar superstructure.

BRIEF DESCRIPTION OF THE DRAWINGS

The present invention is elucidated in greater detail in the following, on the basis of the drawings, in which.

DETAILED DESCRIPTION

Figure 1:
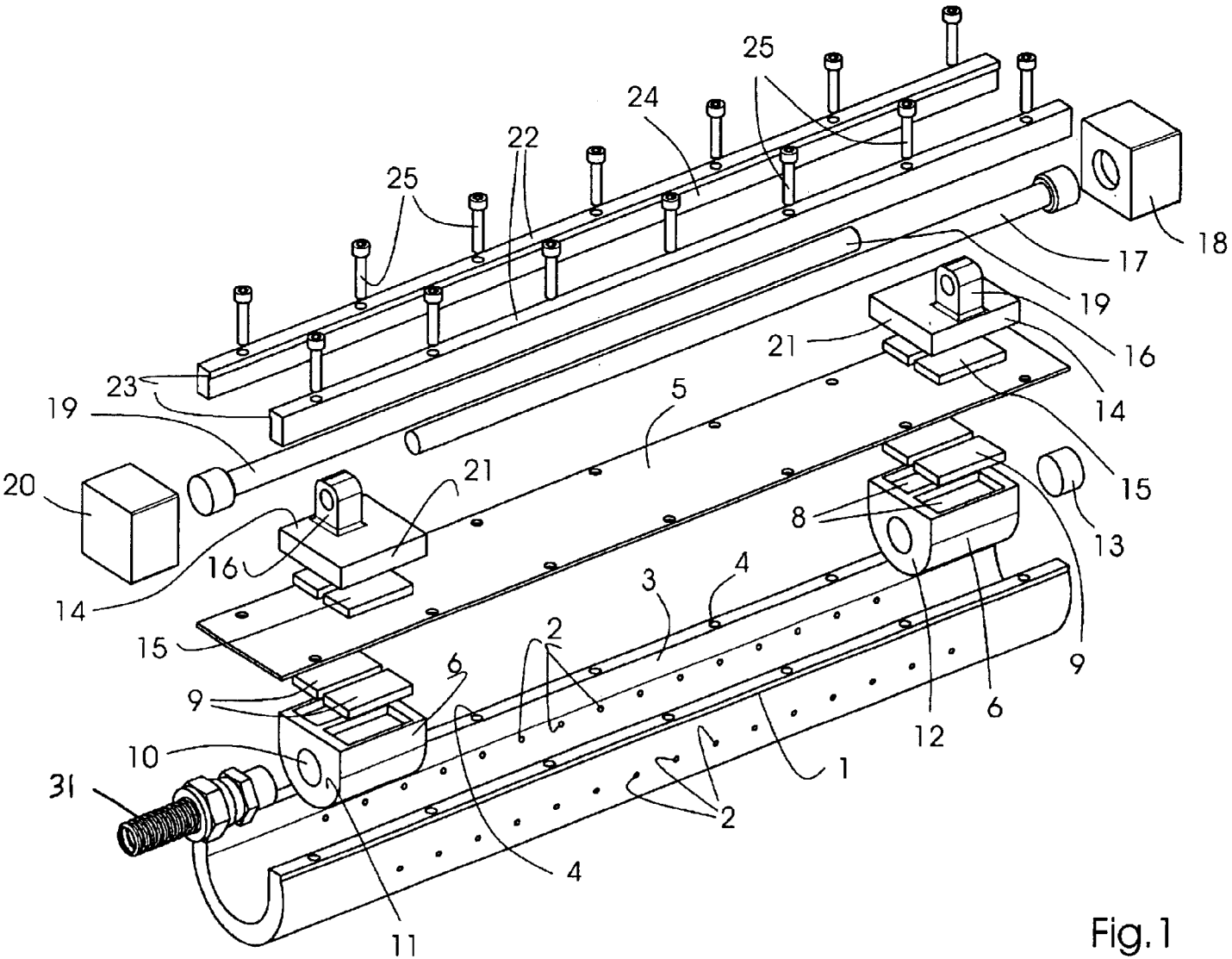
FIG. 1 shows an exploded view of a first embodiment of the angle-bar arrangement.

An angle-bar arrangement in accordance with the present invention emerges in greater detail in an exploded view in FIG. 1.

Viewed over its axial extent, an angle-bar jacket 1 is provided with a plurality of air outlet openings 2, which are accommodated side-by-side in a plurality of rows. Angle-bar jacket 1 has a more or less semicircular contour on the inner side and outer side of its surface area. Located on the top side of the angle-bar jacket are a plurality of openings 4, constituted as bore holes.

Engaging on the rounded inner wall 3 of angle-bar jacket 1 and provided with a corresponding outer contour 7 are closing elements 6, which are movable in the axial direction of angle-bar jacket 1, for example by sliding. Each closing element 6 has a first end face 11 facing the end region of angle-bar jacket 1, as well as a further end face 12, which faces and delimits the hollow space within angle-bar jacket 1. A compressed-air line 31, shown here schematically, is set into a bore hole 32 (FIG. 3) of closing element 6, while, at the diametrically opposed, movable closing element 6, a plug 13 is set in to seal off the hollow space against the loss of compressed air. Formed on the top side of movable closing elements 6 are rectangular recesses 8, in which magnet elements 9 may be set in, for example. Magnet elements 9 are adapted to fit in recesses 8 on movable closing element 6 so as to form a plane surface on the closing element. The top side of angle-bar jacket 1, on which the mutually spaced bore holes are formed, as well as the top side of movable closing elements 6, are sealed off by the bottom side of a flat cover 5. Flat cover 5 is joined by fastening elements 25 to angle-bar jacket 1.

Figure 4:
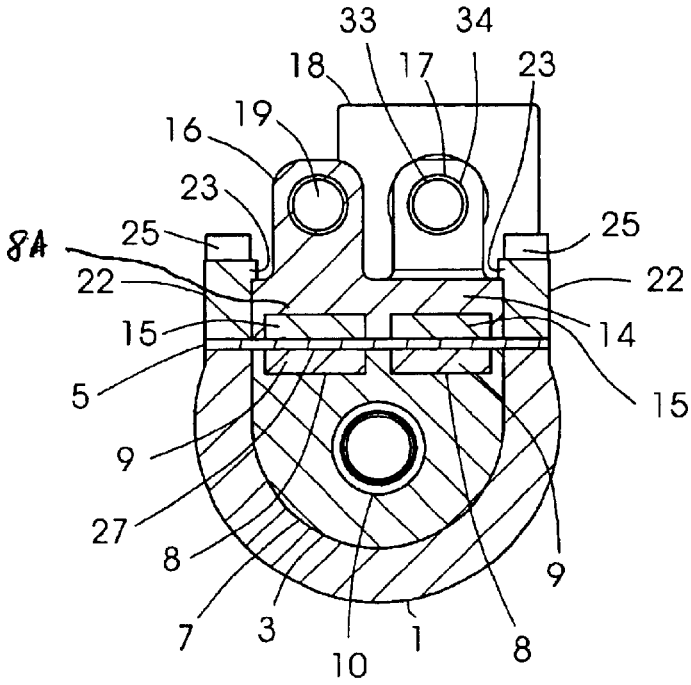
FIG. 4 shows an angle-bar arrangement in cross-section.

Guide rails 22, which are likewise secured by fastening elements 25, are accommodated on the side surfaces of flat cover 5. Guide rails 22 extend essentially in parallel to the longitudinal axis of angle-bar jacket 1 and are provided with a projection 23. Projection 23 extends over the entire length of guide rails 22. Situated beneath guide rails 22, at the rails, are the guide sections used for guiding spindle heads 14 between the two guide rails 22. Guide surface 21, formed at spindle heads 14, is dimensionally sized such that guide rails 22 with their projection 23, just cover the top side of guide surface 21 at spindle head 14. Each of spindle heads 14 is provided with a dome-shaped threaded lug 16. Set in each of spindle heads 14 at the plane bottom side are two magnet elements 15 which correspond to magnet elements 9 of movable closing elements 6. For this purpose, the bottom sides of spindle heads 14, which are movable on the plane surface of flat cover 5, are likewise provided with recesses 8A (FIG. 4). Set into these recesses 8A are magnet elements 15 assigned to spindle heads 14, so that, on the bottom side of spindle heads 14, a plane contact surface results which is movable on the surface of flat sealing element 5.

Assigned, moreover, to the top side of flat sealing element 5 are two actuators 18 and 20, respectively. Actuators 18 and 20 are preferably designed as mutually independently drivable electro-drives. Each of actuators 18 and 20 drives, independently of one another, a corresponding driving spindle 17 or 19, connected to actuator 18 or 20. Driving spindles 17 and 19, respectively, include threaded sections, which extend essentially in parallel to the angle-bar jacket 1, over its entire axial length. The threaded sections of driving spindles 17 and 19, respectively, traverse spindle heads 14 in the region of the internal screw thread of dome-shaped threaded lugs 16.

In the embodiment shown in FIG. 1, each one of spindle heads 14 is able to be guided by its guide surfaces 21 on inner guide surfaces 24 of rails 22. The axial movement, which is impressed upon spindle heads 14 by the rotation of driving spindles 17 and 19, respectively, assigned to each spindle head 14, is transmitted by permanent magnets 15 at the bottom side of spindle heads 14 to permanent magnets 9 at the top side of movable closing elements 6. Since the pairs of magnet elements 9 and 15 are accommodated on spindle head 14 and on the movable closing element 6, respectively, an axial motion is impressed upon movable closing elements 6 in the hollow space of angle-bar jacket 1, in response to axial displacement of spindle heads 14. The axial motion, which is impressed on each of movable closing elements 6, is able to be independently preset for each of movable closing elements 6. In this manner, even material webs which cover angle-bar jacket 1 asymmetrically with respect to the middle position and which are situated off-center with respect to the center of angle-bar jacket 1, are able to be guided in contactless fashion. This is particularly beneficial, for example when the united material webs or material web ribbons in the angle-bar superstructure of a web-processing rotary press are cut by longitudinal slitters into a plurality of partial web ribbons of different widths and, subsequent to the slitting and, if necessary, turning operations, are reunited.

In one embodiment of the approach proposed by the present invention, the electromotively designed actuators 18 and 20 may be accommodated on angle-bar jacket 1 in such a way that driving spindles 17 or 19 directly traverse the hollow space of angle-bar jacket 1. Thus, the possibility exists to directly drive the axially movable closing elements 6 within the hollow space of angle-bar jacket 1. In this embodiment of the idea underlying the present invention, it is also possible to appropriately position, independently of one another, the two movable closing elements 6, which influence the location and the width of the air cushion forming underneath the material web. This embodiment of the idea underlying the present invention has the additional advantage that fewer components are used, and the overall height of angle-bar arrangement 1 turns out to be lower. In this embodiment as well, compressed air may be fed into the hollow space of angle-bar jacket 1 via a bore hole 10 in one of the movably accommodated closing elements 6, while the hollow space within angle-bar arrangement 1 is sealed off by a sealing element 13 in the other movable closing element 6 in question, so that no loss of pressure occurs, and a maximum sealing of the hollow space of angle-bar jacket 1 may be attained.

Figure 2:
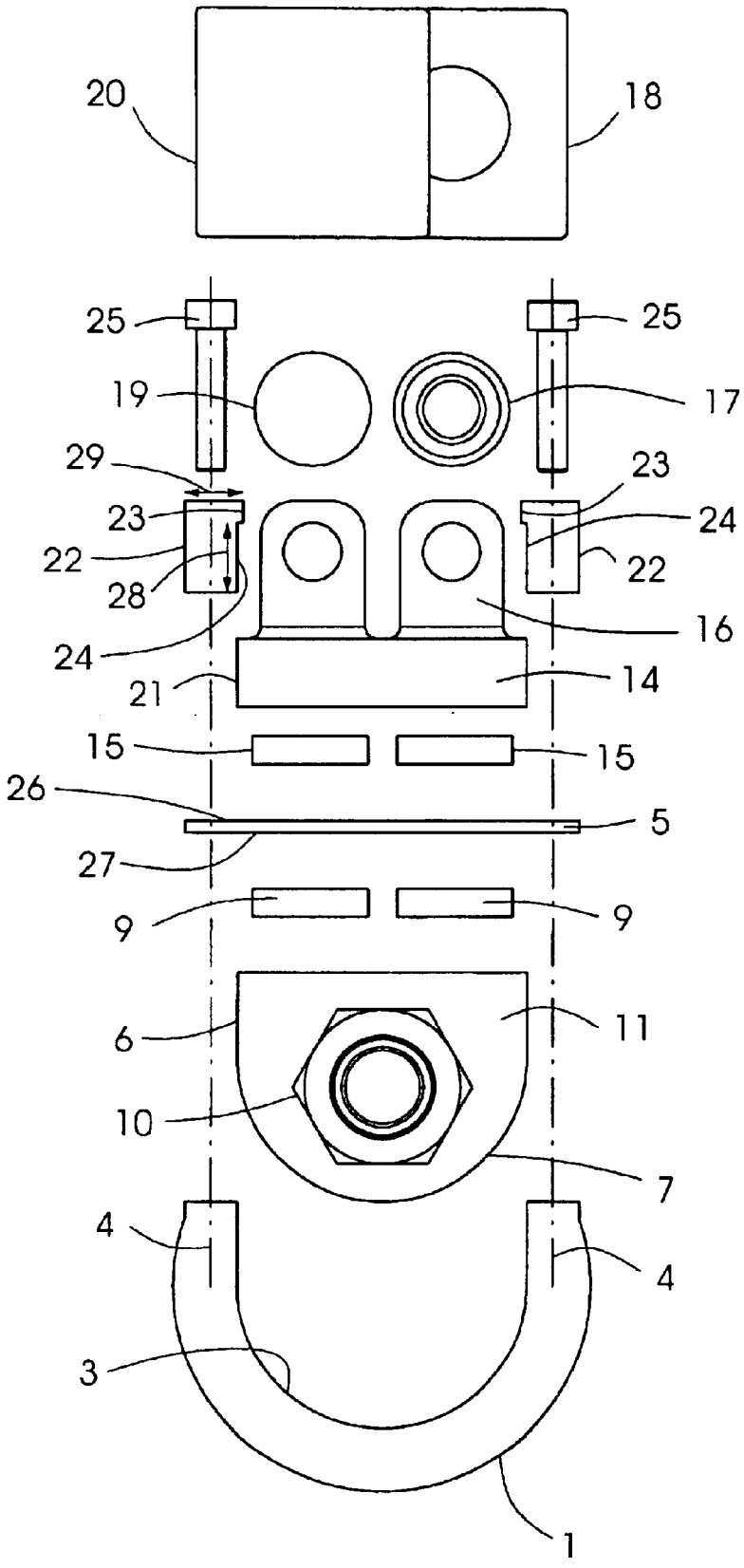
FIG. 2 shows a single-part drawing of the angle bar according to FIG. 1.

A single-part drawing of the angle-bar arrangement according to FIG. 1 is shown in greater detail in the representation according to FIG. 2.

This illustration shows in greater detail curvature 7 of the closing elements 6 which are able to traverse the hollow space of angle-bar jacket 1. Curvature 7 of the outer contour of closing elements 6 which are movable in the hollow space of angle-bar jacket 1 corresponds to the curvature of inner wall 3 of angle-bar jacket 1. On the one hand, this ensures a cant-free guidance of the axially movable closing elements 6; on the other hand, by matching the contours of movable closing element 6 and of inner wall 3 of angle-bar jacket 1, a maximum sealing of the hollow space is able to be achieved within angle-bar jacket 1. Together with the top side of axially movable closing element 6, magnet elements 9, which are inset in the top side of axially movable closing element 6, form a plane surface, which engages on bottom side 27 of flat cover 5. Flat cover 5, for its part, is sealingly joined to angle bar jacket 1 by fastening elements 25, which are received by bore holes 4 in the side walls of angle-bar jacket 1. The bottom plane surface of spindle heads 14 engages on top side 26 of flat cover 5. Inset in the bottom plane surface of spindle heads 14 having dome-shaped threaded member lug 16 are magnet elements 15, which are likewise accommodated by spindle heads 14, such that a plane contact surface of spindle heads 14 results with respect to surface 26 of flat cover 5.

Guide surfaces 24 of rails 22, guiding guide surfaces 21 of spindle heads 14, are designed at a height 28, which corresponds to the height of guide surfaces 21 at spindle heads 14. Extent 29 of projections 23 formed on guide rails 22 perpendicularly to the displacement direction of spindle heads 14 is denoted by reference number 29. Projections 23 ensure that the plane surfaces and guide surface 21 of spindle heads 14 are guided without play on top side 26 of flat cover 5. By way of actuators 18 and 20, shown merely schematically in FIG. 2, driving spindles 17 and 19, respectively, whose threaded sections each drive the thread of the dome-shaped internal threaded lugs 16 at spindle heads 14, are driven independently of one another.

Figure 3:
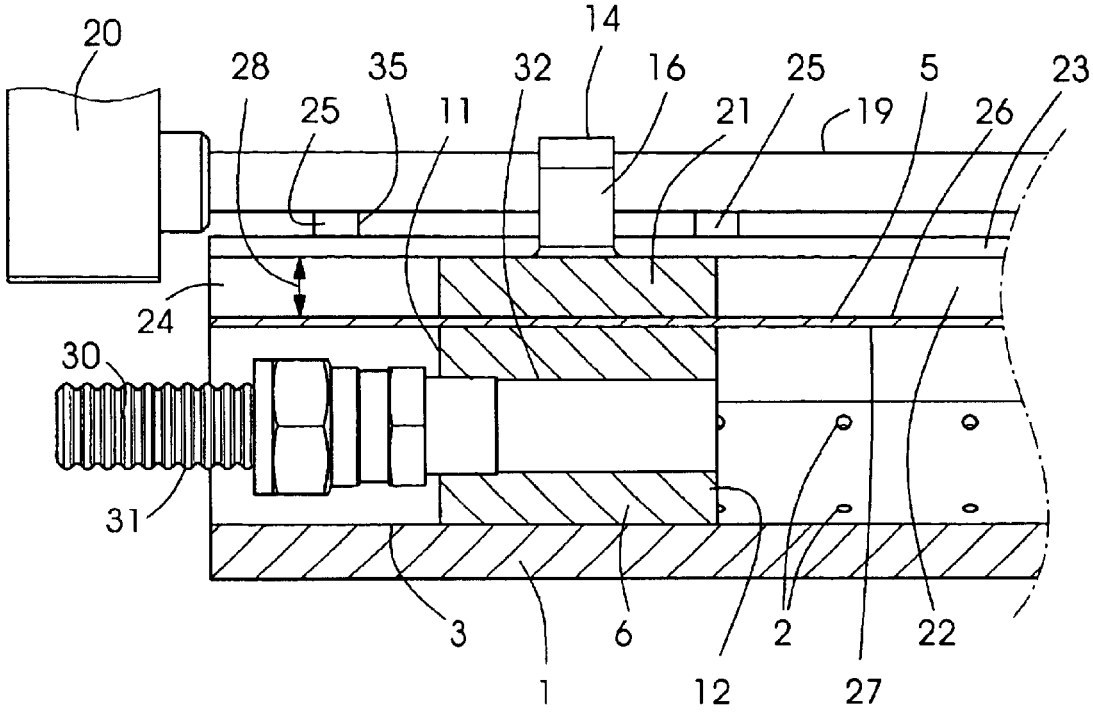
FIG. 3 shows a longitudinal section through the angle-bar arrangement.

The longitudinal section through an angle-bar arrangement according to the present invention is shown in greater detail in the representation according to FIG. 3.

By way of actuator 20, driving spindle 19 joined thereto is able to be set into rotation. The threaded section of driving spindle 19 meshes with an internal thread which is formed in dome-shaped threaded lug 16 of spindle head 14. In this manner, an axial movement relative to guide surface 24 of guide rail 22 is impressed upon spindle head 14. Projection 23, which is formed on guide rail 22, overlaps lateral guide surface 21 of spindle heads 14 and ensures a cant-free guidance of spindle head 14 on top side 26 of flat cover 5. The axial traversing movement or travel of spindle head 14 on surface 26 of flat cover 5 is achieved by magnet elements 15 (see FIG. 1), set in the bottom side of spindle head 14, and, respectively, by magnet elements 9 (See FIG. 1) set in the top side of movable closing element 6. Movable closing elements 6 each have an opening 32, configured, for example, as a bore hole, into which compressed-air line 31 may be screwed. In this manner, it is ensured that the hollow space extending from inner end face 12 of movable closing element 6 in the axial direction of angle-bar jacket 1 is sealed off from outer end face 11 of movable closing element 6. Compressed-air line piece 31 is able to accommodate a threaded section 30, via which the flexible tube for supplying compressed air into the hollow space of angle-bar jacket 1 may be attached.

The axially extending travel path of spindle head 14 or of movable closing element 6 in the hollow space of angle-bar jacket 1 may be predetermined and bounded, for example, by limit stops provided on guide rails 22 or on flat cover 5. In the illustration according to FIG. 3, reference numeral 28 denotes the height of guide surface 24 at rail 22. Reference numeral 25 denotes the fastening elements, which extend through guide rails 22, used for securing both the rails as well as flat cover 5 in bore holes 4 of angle-bar jacket 1. The sealing engagement of the top side of movable closing element 6 on bottom side 27 of the flat sealing arrangement, as well as with outer contour 7 at inner wall 3 of angle-bar jacket 1 ensures a most efficient possible sealing of the hollow space contiguous to inner end face 12 of movable closing element 6. In this manner, it is ensured that the compressed air entering via bore hole 32 into the hollow space of angle-bar jacket 1 flows out exclusively via air outlet openings 2 underneath the material web, an air cushion being formed there, so that, depending on the position of axially movable closing elements 6, an air cushion suitable for the web format to be processed is built up.

A cross-section through the angle-bar arrangement according to the present invention is shown in greater detail in the representation according to FIG. 4.

From the illustration according to FIG. 4, one can discern that projections 23 configured at rails 22 overlap the base areas of spindle heads 14. Guide surfaces 21 of spindle heads 14 engage on guide surfaces 24 of rails 22, so that when driving spindles 17 and 19 rotate in response to electromotively configured actuators 18 and 20, respectively, (not shown here), a cant-free guidance of spindle heads 14 is ensured at top side 26 of flat cover 5. The formation of recesses at the bottom side of spindle heads 14 and/or in the upper region of movable closing elements 6 permits a plane engagement of these elements at the sides of flat cover 5, thereby further enhancing the sealing action with respect to the incoming compressed air. Outer contour 7 of movable closing elements 6 sealingly engages on inner wall 3 of angle-bar jacket 1 such that the outflow of compressed air through the gap between inner wall 3 of angle-bar jacket 1 and outer contour 7 of axially movable closing elements 6 is negligible compared to the volumetric air flow issuing through air outlet openings 2 in angle-bar jacket 1. Fastening elements 25 are used both for fixing rails 22 at top side 26 of flat cover 5, as well as for locating them in position with respect to the top side of angle-bar jacket 1.

Figure 5:
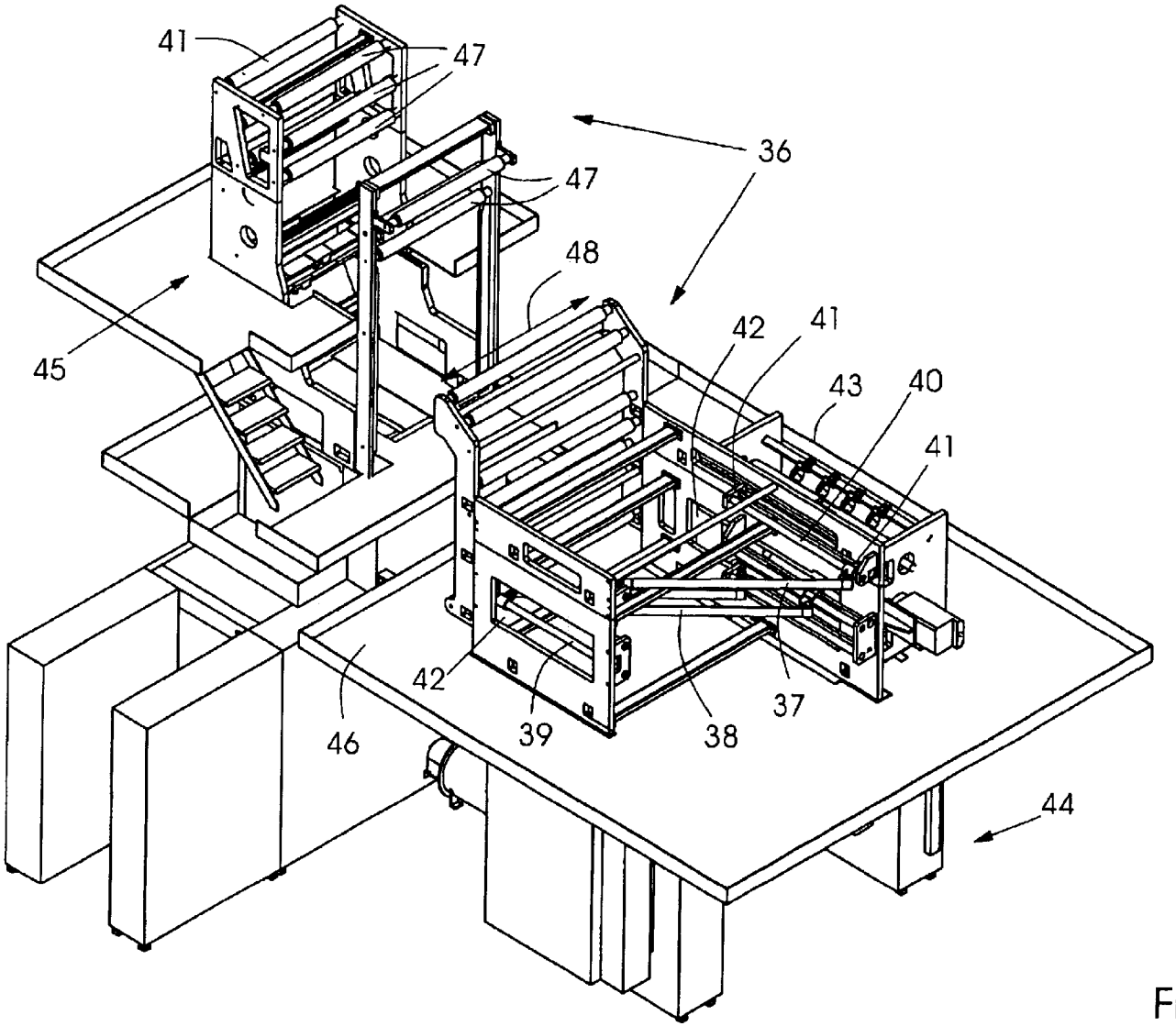
FIG. 5 shows an angle-bar superstructure assigned to a web-processing rotary press.

An angle-bar superstructure assigned to a web-processing rotary press is shown in greater detail in the representation according to FIG. 5.

Normally, an angle-bar superstructure 36 on web-processing rotary presses, whether they be commercial web presses or newspaper rotary presses, has a downstream drying or chill roll section. Accommodated in a stationary mount in superstructure region denoted by reference numeral 45 are a plurality of web guide rollers 47, over which the material webs or material web ribbons, printed on one or both sides, are fed from a plurality of material web positions into angle-bar superstructure 36. The maximally processable web format with respect to the material web width is denoted by reference numeral 48. Depending on the web travel pattern and infeed pattern into folder 44, one can conceive of various and individually adjustable angle-bar configurations in angle-bar superstructure 36. In addition to angle bars constructed in a first length 37 and variable in their angular position, angle bars constructed in a second length 38 may also be accommodated in displaceable fashion, i.e. in a sliding configuration, in superstructure 36. The angle bars, whether constructed in a first length 37 or in a second length 38, may be supported both in a stationary mount, as well as accommodated on slide-type elements 41 which allow displacement. Provided in angle-bar superstructure 36 on a platform 46 in a stationary mount are deflecting rolls 39, to which window-type deflecting openings 42 are assigned, as well as longitudinal slitting sections 43 having a plurality of longitudinal slitter blades configured side-by-side at various distances from one another. With the assistance of the adjustable longitudinal slitter blade accommodated on a cross bar, the turned material web, printed on one or both sides, or a multi-layer material web ribbon is able to be brought together into material web ribbons of different widths, to be folded crosswise in folder cylinder part 44 and to be slit crosswise. By constructing angle bars in different lengths 37 or 38, an enormous flexibility of the angle-bar superstructure is able to be achieved with respect to the material web formats to be processed; the approach proposed by the present invention enhances this flexibility by making it possible to adjust, in any way desired, the region in which material webs of the widely varying widths are guided, without making contact, on angle-bar surfaces.

The guide rails permit a tracked motion of the closing elements in the angle bar jacket.

| Reference Numeral List | |
|---|---|
| 1 | angle-bar jacket |
| 2 | air outlet openings |
| 3 | inner wall |
| 4 | bore hole |
| 5 | flat cover |
| 6 | movable closing element |
| 7 | curvature |
| 8 | recess |
| 9 | magnet element |
| 10 | opening for line |
| 11 | outer end face |
| 12 | inner end face |
| 13 | plug |
| 14 | spindle head |
| 15 | magnet element |
| 16 | threaded lug |
| 17 | first driving spindle |
| 18 | first actuator |
| 19 | second driving spindle |
| 20 | second actuator |
| 21 | lateral guide surface |
| 22 | guide rail |
| 23 | projection |
| 24 | guide surface of rail |
| 25 | fastening element |
| 26 | top side of cover |
| 27 | bottom side of cover |
| 28 | height of guide surface |
| 29 | projection width |
| 30 | thread |
| 31 | compressed-air line |
| 32 | bore hole |
| 33 | internal screw thread of threaded member |
| 34 | external screw thread of driving spindle |
| 35 | limit stops of travel path |
| 36 | angle-bar superstructure |
| 37 | first angle-bar length |
| 38 | second angle-bar length |
| 39 | stationary angle bars |
| 40 | movable angle bar |
| 41 | slides |
| 42 | window |
| 43 | longitudinal slitter |
| 44 | folder cylinder part |
| 45 | infeed region of superstructure |
| 46 | platform |
| 47 | guide roller |
| 48 | maximally processable format |

What is claimed is:

1. An angle-bar for deflecting material webs in a rotary press comprising:

an angle-bar jacket having an axial length and a width, the axial length being greater than the width, and having a plurality of axially-spaced air outlet openings;

closing elements for sealing off the air outlet openings, the closing elements being axially movable in the angle bar jacket, compressed air being fed into a hollow space of the angle-bar jacket delimited by the closing elements; and actuators, the closing elements being guided in the angle-bar jacket via rails and being mutually independently movable by the actuators; the closing elements having an outer curved surface matching an inner curved surface of the angle-bar jacket.

2. The angle-bar as recited in claim 1 further comprising driving spindles, the closing elements being movably accommodated on driving spindles.

3. The angle-bar as recited in claim 1 further comprising guide rails, the guide rails being located in a region of the angle-bar jacket facing away from the air outlet openings, the guide rails having projections extending and running in parallel to the angle-bar jacket.

4. A method for adjusting an angle-bar for deflecting material webs in a rotary press, the angle-bar having an angle-bar jacket having an axial length and a width shorter than the axial length, the angle-bar jacket having a plurality of axially-spaced air outlet openings and closing elements for sealing off the air outlet openings, compressed air being fed into a hollow space of the angle-bar jacket delimited by the closing elements, the method comprising the steps of:

moving axially one of the closing elements in the angle-bar jacket via an actuator in a tracked motion; and moving independently another of the closing elements in the angle-bar jacket via another actuator in a tracked motion;

wherein the closing elements have an outer curved surface matching an inner curved surface of the angle-bar jacket.

5. An angle-bar for deflecting material webs in a rotary press comprising:

an angle-bar jacket having a plurality of axially-spaced air outlet openings;

closing elements for sealing off the air outlet openings, the closing elements being movable in the angle bar jacket, each closing element capable of closing at least two of the axially-spaced air outlet openings, compressed air being fed into a hollow space of the angle-bar jacket delimited by the closing elements; and actuators, the closing elements being guided in the angle-bar jacket via rails and being mutually independently movable by the actuators.

6. The angle-bar as recited in claim 5 further comprising a compressed-air line for providing compressed air through one of the closing elements into the hollow space.

7. The angle-bar as recited in claim 5 wherein the closing elements are movable within the angle-bar jacket in response to a magnetic force.

8. The angle-bar as recited in claim 7 further comprising movable spindle heads with first magnet elements, the closing elements further including second magnet elements cooperating with the first magnet elements.

9. The angle-bar as recited in claim 8 further comprising a flat cover, the angle-bar jacket being sealingly closed by the flat cover, wherein the spindle heads are capable of travel in a region of the flat cover facing away from the air outlet openings.

10. The angle-bar as recited in claim 7 further comprising a flat cover, the angle-bar jacket being sealingly closed by the flat cover, the magnetic force being effective through the flat cover.

11. The angle-bar as recited in claim 5 further comprising a flat cover, the angle-bar jacket being sealingly closed by the flat cover.

12. The angle-bar as recited in claim 11 wherein the actuators of the closing elements are located in a region of the flat cover facing away from the air outlet openings, and further comprising spindle heads having magnets being accommodated on the flat cover.

13. The angle-bar as recited in claim 5 wherein the closing elements have an outer contour, the outer contour of the movable closing elements corresponding to an inner contour of the angle-bar jacket.

14. The angle-bar as recited in claim 5 wherein the closing elements are provided with an opening for a compressed-air line.

15. An angle-bar superstructure in a web-processing rotary press comprising the angle-bar as recited in claim 5.

16. A folder having an angle-bar superstructure with at least one angle-bar for deflecting material webs as recited in claim 5.

17. The angle-bar as recited in claim 5 wherein the closing elements have an outer curved surface matching an inner curved surface of the angle-bar jacket.

18. The angle-bar as recited in claim 5 further comprising guide rails, the guide rails being located in a region of the angle-bar jacket facing away from the air outlet openings, the guide rails having projections extending and running in parallel to the angle-bar jacket.

19. The angle-bar as recited in claim 5 further comprising driving spindles, the closing elements being movably accommodated on driving spindles.

* * * * *